US012378495B2

(12) United States Patent
Kalita

(10) Patent No.: US 12,378,495 B2
(45) Date of Patent: Aug. 5, 2025

(54) TRIBOTECHNICAL COMPOSITIONS FROM SELF-ASSEMBLED CARBON NANOARCHITECTONICS, AND APPLICATIONS THEREOF

(71) Applicant: P & S Global Holdings, LLC, Houston, TX (US)

(72) Inventor: Parash Kalita, Houston, TX (US)

(73) Assignee: P & S Global Holdings LLC, Houston, TX (US)

( * ) Notice: Subject to any disclaimer, the term of this patent is extended or adjusted under 35 U.S.C. 154(b) by 291 days.

(21) Appl. No.: 17/918,053

(22) PCT Filed: Dec. 28, 2020

(86) PCT No.: PCT/US2020/067137
§ 371 (c)(1),
(2) Date: Oct. 10, 2022

(87) PCT Pub. No.: WO2022/139853
PCT Pub. Date: Jun. 30, 2022

(65) Prior Publication Data

US 2023/0151293 A1 May 18, 2023

Related U.S. Application Data

(60) Provisional application No. 63/129,371, filed on Dec. 22, 2020.

(51) Int. Cl.
*C10M 139/04* (2006.01)
*C10M 125/02* (2006.01)
*C10N 40/25* (2006.01)

(52) U.S. Cl.
CPC ..... *C10M 139/04* (2013.01); *C10M 125/02* (2013.01); *C10M 2201/041* (2013.01); *C10N 2040/25* (2013.01)

(58) Field of Classification Search
CPC ..... C10N 2020/02; C10N 2050/10; C10N 2040/04; C10N 2040/25; C10N 2030/06;
(Continued)

(56) References Cited

U.S. PATENT DOCUMENTS

2008/0271967 A1 11/2008 Nakatani et al.
2016/0046501 A1* 2/2016 Kverel ..... C01G 41/00 977/734

OTHER PUBLICATIONS

Wang, et al. "Trilayered Film with Excellent Tribological Performance: A Combination of Graphene Oxide and Perfluoropolyethers" Tribology Letter, 2015; vol. 60, Issue 41, pp. 1-7 entirety of document.

(Continued)

*Primary Examiner* — Vishal V Vasisth
(74) *Attorney, Agent, or Firm* — Kean Miller LLP; Robert Devin Ricci; Lauren J. Rucinski

(57) ABSTRACT

In one or more embodiments, this application relates to tribotechnical additive and lubricant compositions based on self-assembled carbon nanoarchitectonics derived through nanoscale modifications of organosilane-functionalized nanocarbon with one or multiple combinations of organo-molybdenum, organo-boron, organo-sulfur, organo-phosphorus, and heterocyclic compounds. The novel lubricant is characterized by having a composition comprising (A) one or more types of the novel additive compositions, (B) Base oil//lubricant, and optionally (C) one or more additives selected from the group including antioxidants, dispersants, detergents, anti-wear additives, extreme pressure additives, friction modifiers, viscosity index modifiers, seal swell additives, defoamers, pour point depressants and corrosion/rust inhibitors. The selfassembled carbon nanoarchitectonics is expected to enhance the surface chemistry, antiwear, antifriction, antioxidancy, electrothermal, and corrosion (Continued)

An illustration of the invention showing (A) amine-functionalized nanocarbon from organosilane modification and (B) organic modification of functionalized and pristine nanocarbon inhibiting characteristics of the tribotechnical compositions for formulating high-quality solutions in a wide range of applications.

10 Claims, 8 Drawing Sheets

(58) Field of Classification Search
CPC ..... C10N 2030/28; C10N 2040/02; C10N 2050/02; C10N 2030/12; C10N 2010/12; C10N 2010/02; C10N 2010/04; C10M 125/02; C10M 139/04; C10M 159/12; C10M 139/00; C10M 2223/049; C10M 2213/062; C10M 2219/066; C10M 2203/1065; C10M 2207/1265; C10M 2223/042; C10M 2227/061; C10M 2215/1026; C10M 2215/223; C10M 2201/041; C10M 2219/068
See application file for complete search history.

(56) References Cited

OTHER PUBLICATIONS

Sun, et al "Application of Graphene Derivatives and Their Nanocomposies in Tribology and Lubrication: a Review RSC Advances". 2019, vol. 9.
Gelest "Silane Coupling Agents" Copyright 2014.
Liu, "Composite Nanosheets of Graphene and Boron Nitride for Lubrication Application" Masters Thesis, Deakin University, Nov. 2017; entirety of document.

* cited by examiner

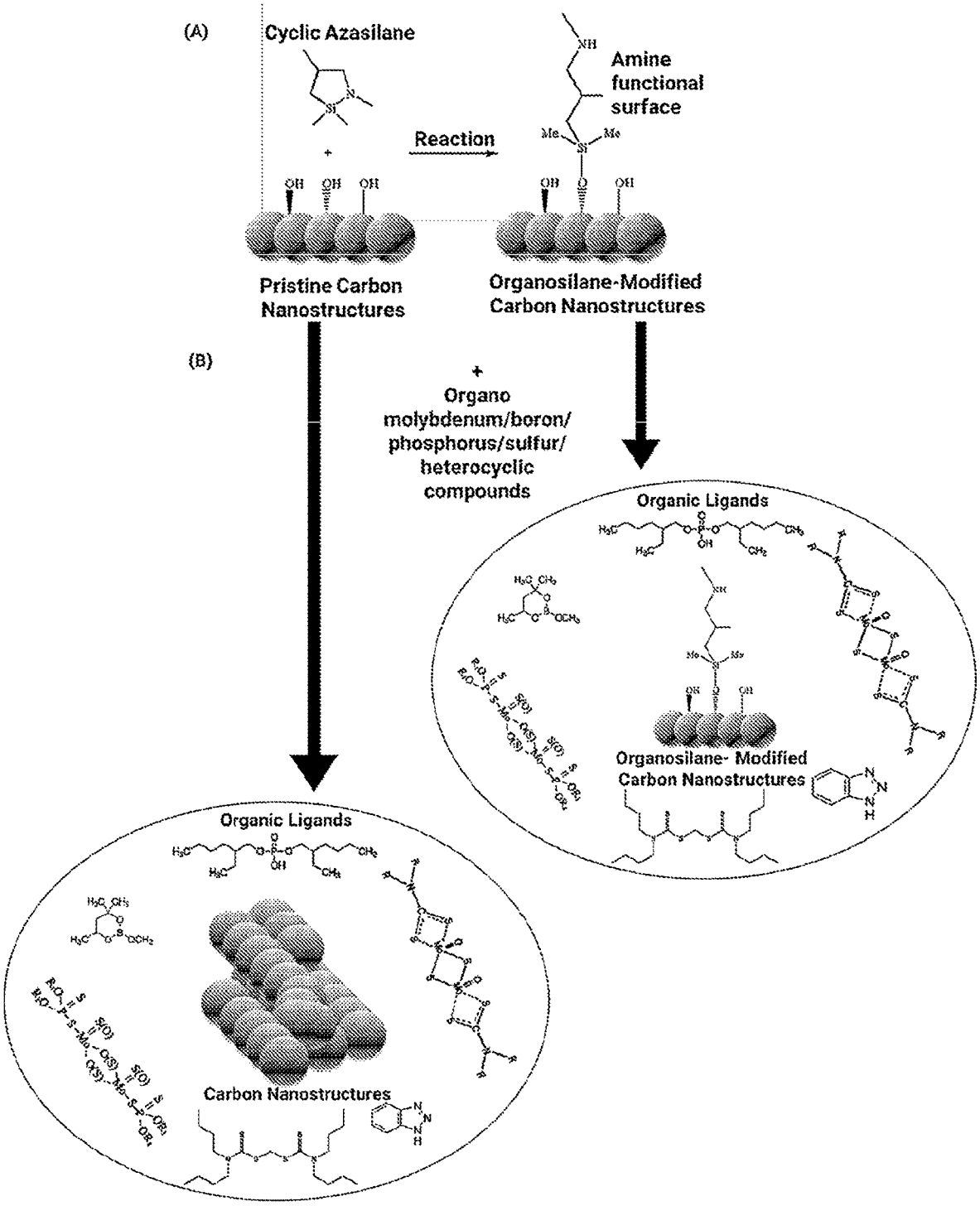
Figure 1. An illustration of the invention showing (A) amine-functionalized nanocarbon from organosilane modification and (B) organic modification of functionalized and pristine nanocarbon

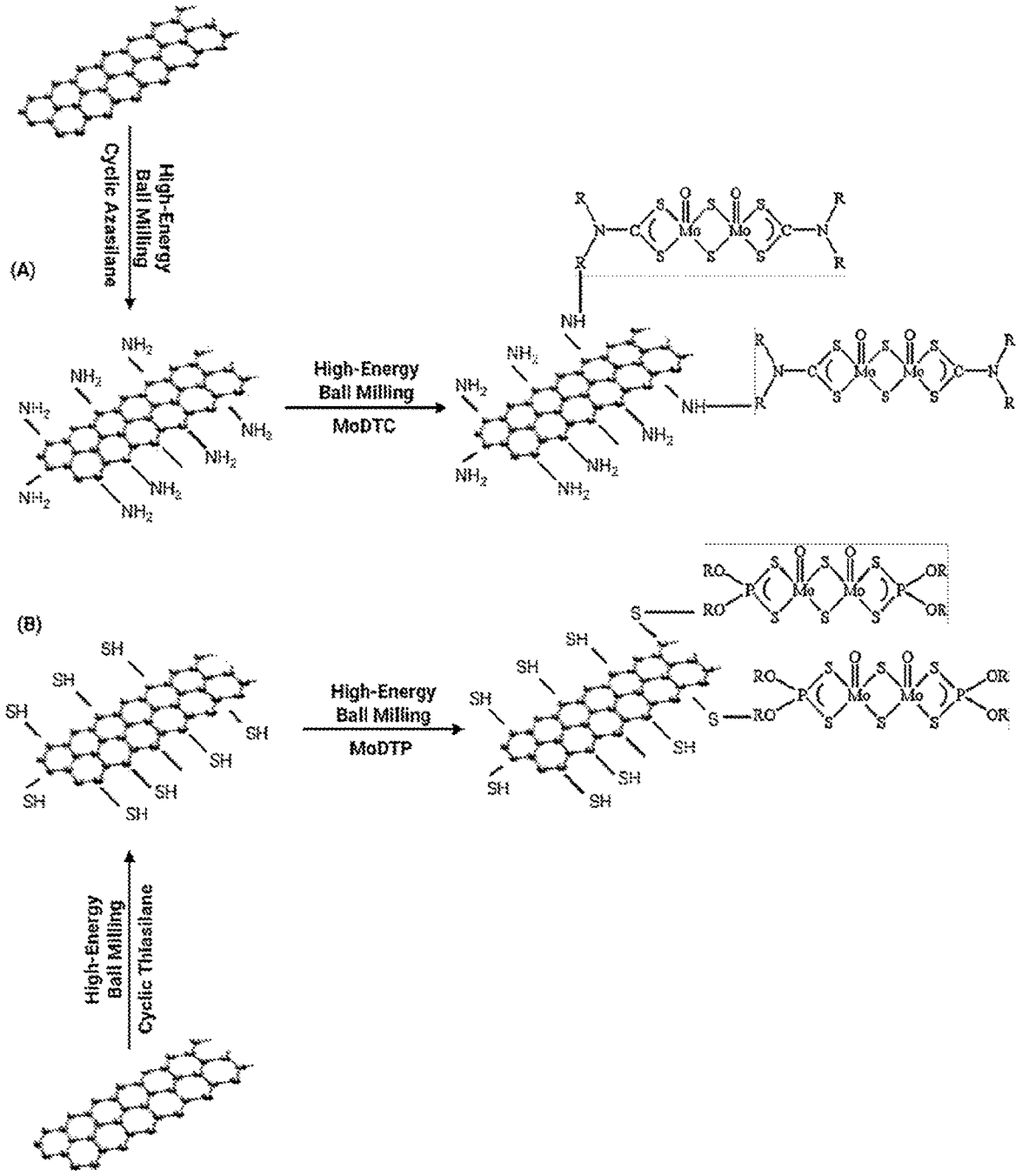
Figure 2. An illustration of novel graphene-based additives derived from (A) molybdenum dithiocarbamate (MoDTC) self-assembly with amine-functionalized graphene nanoplatelets, and (B) molybdenum dithiophosphate (MoDTP) self-assembly with thiol-modified graphene nanoplatelets

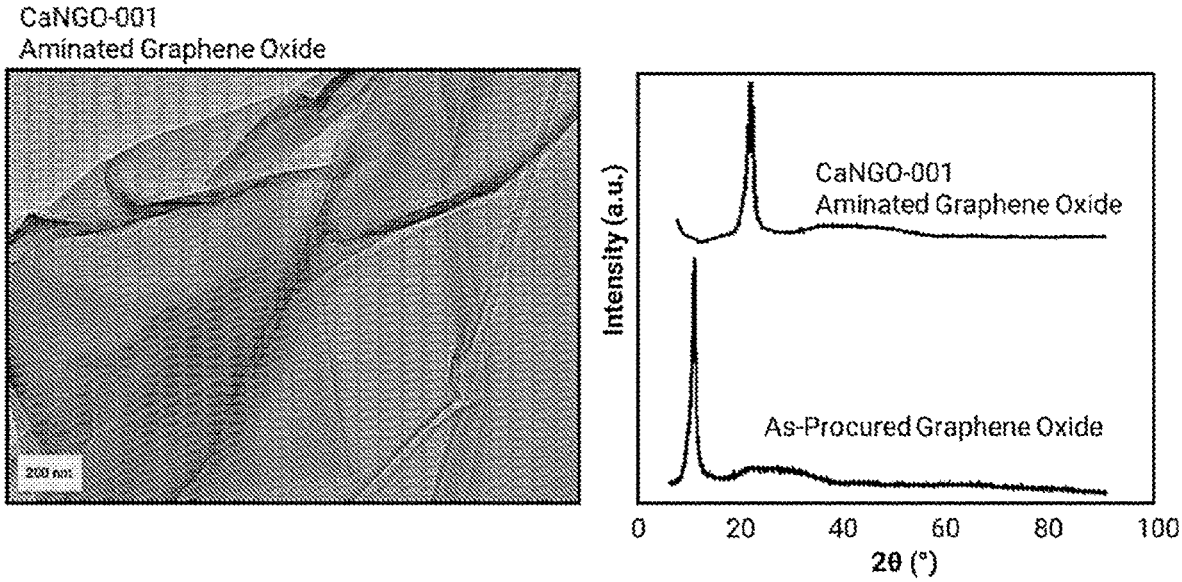
Figure 3. A high-resolution TEM image and XRD analysis of the novel organosilane-modified graphene oxide (CaNGO-001 composition)

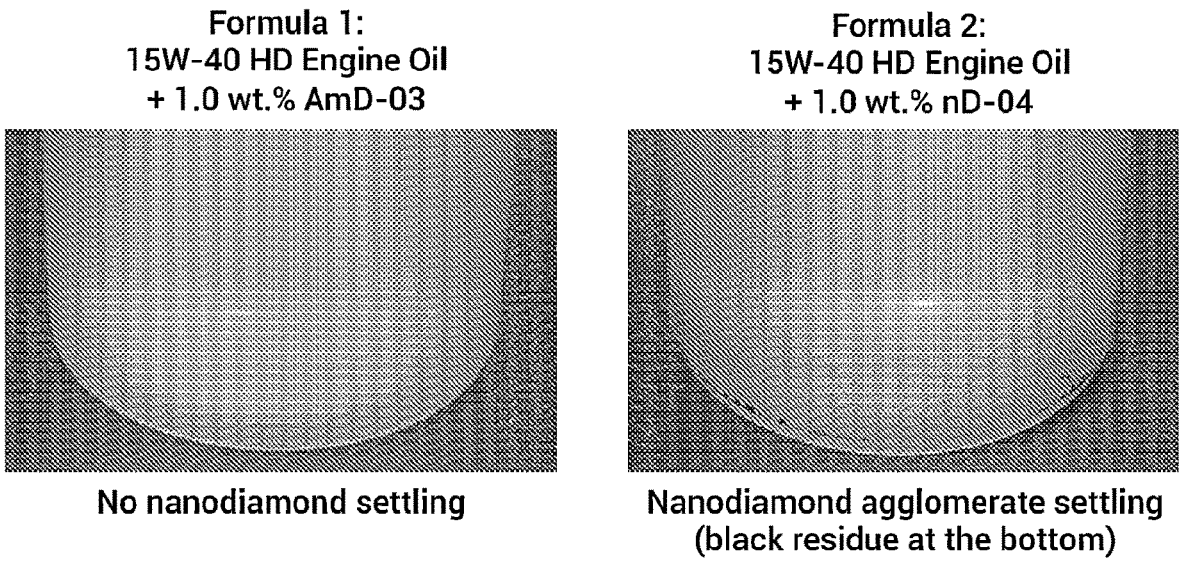
Figure 4. Dispersion stability of diesel engine oil containing the novel additives

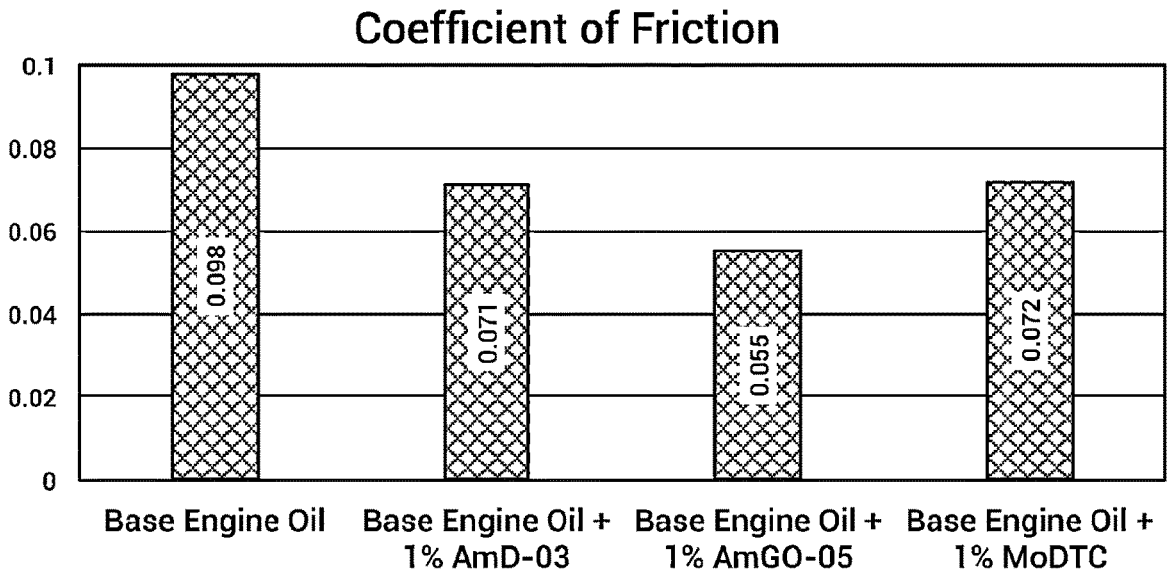
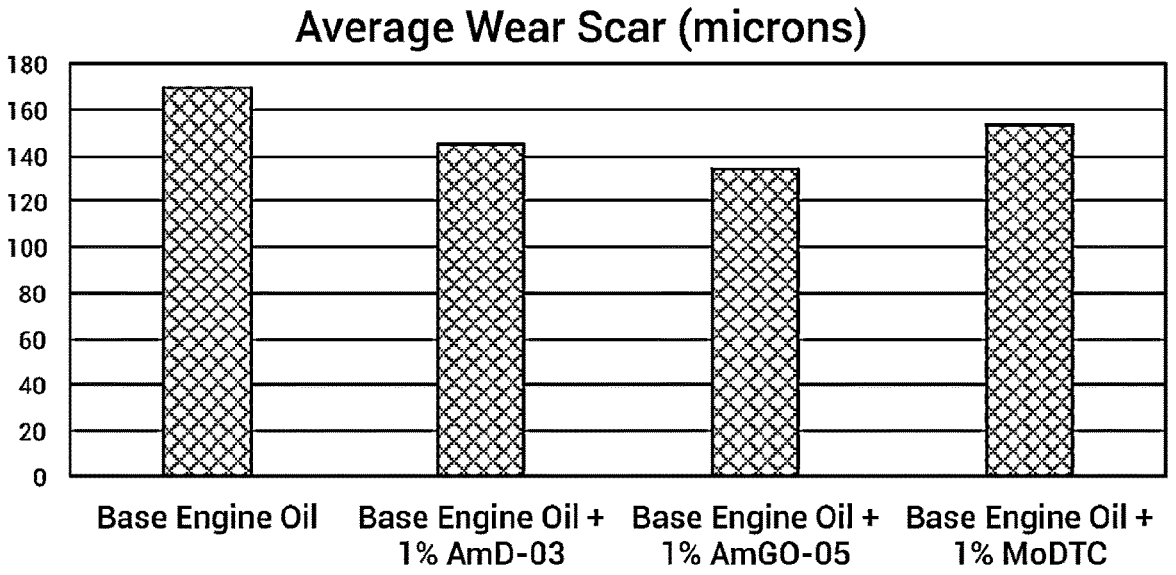
Figure 5. HFRR testing results of diesel engine oils containing the novel additives

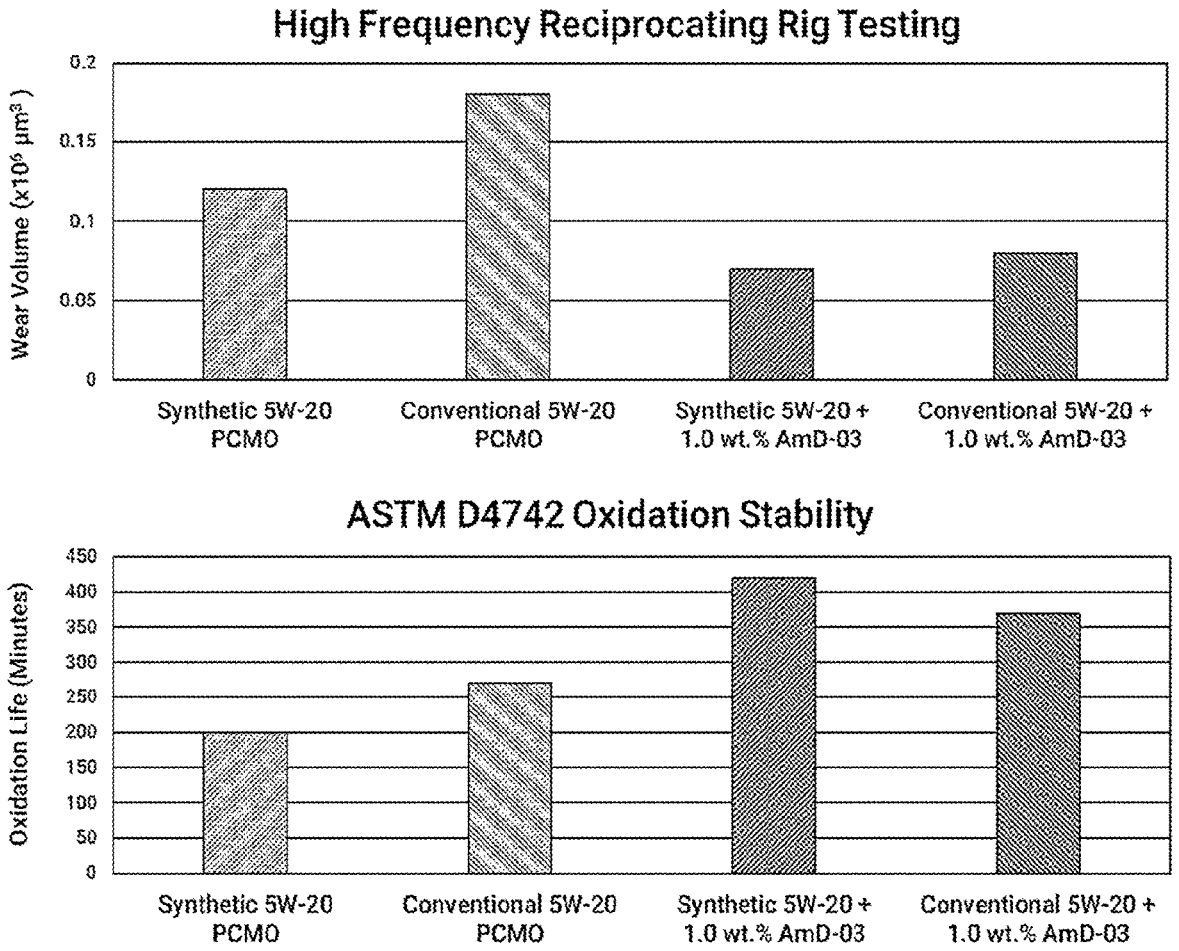
Figure 6. High frequency reciprocating rig (HFRR) and oxidation stability testing results of motor oils containing the novel additives

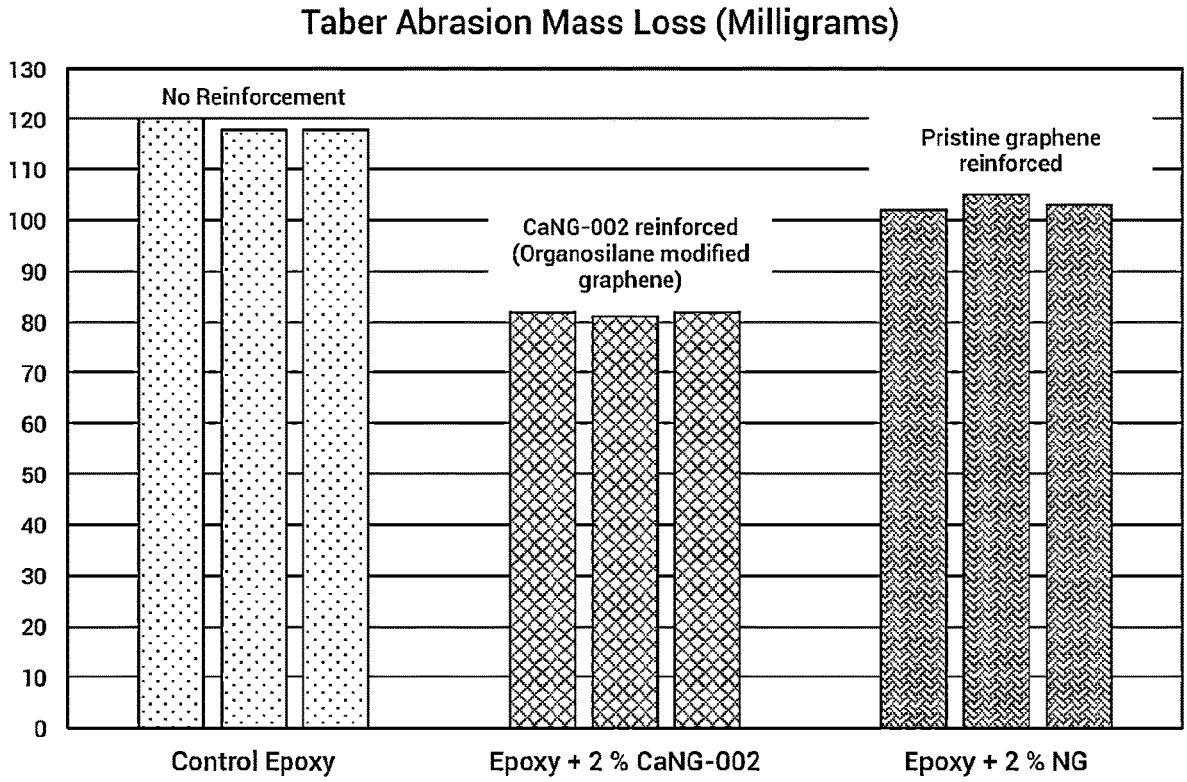
Figure 7. Taber abrasion mass loss of novel additive reinforced epoxy

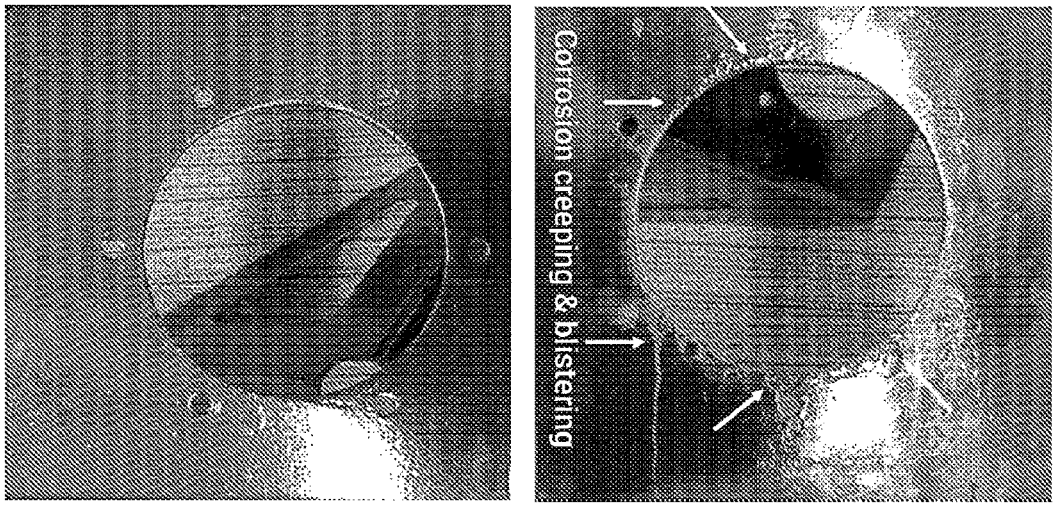
(A) AmG-02 reinforced coating (B) Control coating
Figure 8. 500 hours ASTM B117 salt fog testing of polyurethane coating containing the novel additive

TRIBOTECHNICAL COMPOSITIONS FROM SELF-ASSEMBLED CARBON NANOARCHITECTONICS, AND APPLICATIONS THEREOF

CROSS-REFERENCE TO RELATED APPLICATIONS

This application is a 35 USC § 371 National Stage application of International Application No. PCT/US20/67137 filed Dec. 28, 2020, now pending; which claims the benefit under 35 USC § 119 (e) to U.S. Application Ser. No. 63/129,371 filed Dec. 22, 2020, now expired. The disclosure of each of the prior applications is considered part of and is incorporated by reference in the disclosure of this application.

INDUSTRIAL APPLICATION

This application presents a new class of high-performance tribotechnical compositions based on self-assembled carbon nanoarchitectonics with unique nanostructural, surface, and tribochemical characteristics for realization in a wide range of nanotechnology field, including nanolubrication, pharmaceutical, optoelectronics, polymer nanocomposites, nanocoatings, and biomedical applications.

DESCRIPTION OF THE DRAWINGS

FIG. 1 is an illustration of the invention showing (A) amine-functionalized nanocarbon from organosilane modification and (B) organic modification of functionalized and pristine nanocarbon.

FIG. 2 is an illustration of novel graphene-based additives derived from (A) molybdenum dithiocarbamate (MoDTC) self-assembly with amine-functionalized graphene nanoplatelets, and (B) molybdenum dithiophosphate (MoDTP) self-assembly with thiol-modified graphene nanoplatelets.

FIG. 3 shows a side by side high-resolution TEM image and XRD analysis of the novel organosilane-modified graphene oxide (CaNGO-001 composition).

FIG. 4 shows dispersion stability of diesel engine oil containing the novel additives.

FIG. 5 presents two charts showing HFRR testing results of diesel engine oils containing the novel additives.

FIG. 6 presents two charts showing results of HFRR and oxidation stability testing results of motor oils containing the novel additives FIG. 7 is a chart showing results of taber abrasion mass loss of novel additive reinforced epoxy.

FIG. 8 is a pictorial image showing results of 500 hours ASTM B117 salt fog testing of polyurethane coating containing the novel additive.

BACKGROUND OF THE INVENTION

Over the past decade, carbon-based nanomaterials/nanostructures have been one of the most widely studied material in the field of nanotechnology. Compared to any other material on earth, carbon has the unique ability to organize in different allotropic forms: from the zero-dimension fullerenes and carbon dots, to the one dimensional carbon nanotubes (single wall and multiwall CNTs), to the two-dimensional graphene/graphene oxide sheet/platelets, to the 3D bulk graphite or diamond crystals where atoms are pure sp2 or sp3 hybrids organized in the hexagonal or cubic lattice, respectively. Owing to their unique structural properties from high surface-to-volume ratio and excellent mechanical, electrical, thermal, optical and chemical properties, carbon nanostructures have attracted significant interest in diverse areas, including biomedical, drug delivery, electronics, composite materials, sensors, field emission devices, energy storage and conversion, etc.

Surface functionalization, patterning, alignment, orientation, and assembly into functional networks are key steps for fabrication and application of nanomaterials including nanocarbon with unique properties. Nanoarchitectonics provides one such novel concept for fabrication of functional nanomaterials through combination of various actions including molecular modifications, chemical reactions, self-assembly, self-organization, organic synthesis and field-induced interactions. The nanoarchitectonics approach of the present invention is fabrication of self-assembled nanocarbon through a combinative bottom-up and top-down methodology of nanoscale modification of carbon-based nanostructures with selective organic ligands (anhydrous) catalyzed by mechanochemical interactions.

SUMMARY

In one or more embodiments, this application relates to tribotechnical additive and lubricant compositions based on self-assembled carbon nanoarchitectonics derived through nanoscale modifications of organosilane-functionalized nanocarbon with one or multiple combinations of organomolybdenum, organo-boron, organo-sulfur, organo-phosphorus, and heterocyclic compounds. The novel lubricant is characterized by having a composition comprising (A) one or more types of the novel additive compositions, (B) Base oil//lubricant, and optionally (C) one or more additives selected from the group including antioxidants, dispersants, detergents, anti-wear additives, extreme pressure additives, friction modifiers, viscosity index modifiers, seal swell additives, defoamers, pour point depressants and corrosion/rust inhibitors. The self-assembled carbon nanoarchitectonics is expected to enhance the surface chemistry, antiwear, antifriction, antioxidancy, electrothermal, and corrosion inhibiting characteristics of the tribotechnical compositions for formulating high-quality solutions in a wide range of applications.

DETAILED DESCRIPTION

This application presents a new class of high-performance tribotechnical compositions based on self-assembled carbon nanoarchitectonics with unique nanostructural, surface, and tribochemical characteristics for realization in a wide range of nanotechnology field, including nanolubrication, pharmaceutical, optoelectronics, polymer nanocomposites, nanocoatings, and biomedical applications. As shown in the illustrative embodiments disclosed herein, the novel nanoarchitectonics methodology is based on tandem combination of selective organic ligands self-assembly with organosilane-functionalized nanocarbon, catalyzed by mechanochemical interactions of simultaneous stress-induced chemical reactions and structural changes in materials.

In the present invention, nanocarbon structures have at least one dimension less than 100 nm and may be comprised of one or more than one type of 0-, 1-, 2- and 3-dimensional inorganic carbon with sp2 and sp3 hybridization allotropes, including fullerene/onion-like carbon, multiwall & single walled carbon nanotubes, graphene, graphene oxide, graphite, carbon black, nanodiamond, and bucky nanodiamond. The present invention also includes aminated (amine-functional) and sulfhydrylated (thiol-functional) carbon nanostructures derived from nanoscale functionalization with anhydrous organosilane reagents, and will be referred to as organosilane modified-nanocarbon from here onwards. Carbon nanostructures not modified with organosilane will be referred to as pristine nanocarbon from here onwards.

In the novel tribotechnical additive compositions, the proportion of carbon nanostructures (organosilane-modified and/or pristine) may range from 1-50 wt. % and organic compounds 50-99 wt. %. The organic compounds may include organic molybdenum, boron, phosphorus, sulfur, and heterocyclic compounds as listed below, or combinations thereof.

The organomolybdenum compounds may be selected from group consisting of Molybdenum Dithiocarbamates (MoDTC) and Molybdenum Dithiophosphate (MoDTP), and Molybdenum Dialkyldithiophosphate (MoDDP).

The organoboron compounds may be selected from group consisting of Trimethoxyboroxine, 2-Methoxy-4,4,6-trimethyl-1,3,2-dioxaborinane, 2-Ethoxy-4,4,6-trimethyl-1,3,2-dioxaborinane, and Trimethyl borate.

The organophosphorus compounds may be Bis(2-ethylhexyl) phosphate, Trioleyl phosphite, Trilauryl trithio phosphite, Dilauryl hydrogen phosphite, Diphenyl hydrogen phosphite, Ethyl acid phosphate, Butyl acid phosphate, 2-Ethylhexyl acid phosphate, Dibutyl phosphite, Dioleyl hydrogen phosphite, Butoxyethyl acid phosphate, Ethylene glycol acid phosphate, and Dibutyl phosphate.

The organosulfur compound may be Methylenebis (dibutyldithiocarbamate), while heterocyclic compounds may be selected from Benzotriazoles and 1,3,4-Thiadiazoles group.

The instant embodiment provides a cost-effective two-step nanoarchitectonics approach involving combinative bottom-up and top-down mechanochemical processes for generating self-assembled nanocarbon compositions comprising: Step 1: organosilane modifications to create organofunctionalized nanocarbon structures; and Step 2: combination of organic ligands self-assembly with organofunctionalized carbon nanostructures.

Step 1. Organosilane modification of carbon nanostructures: The organosilane modification is achieved through a temperature-controlled anhydrous reaction of carbon nanostructures with volatile coupling reagents belonging to the group of cyclic azasilanes and cyclic thiasilanes in presence of aprotic solvents such as hydrocarbons or tetrahydrofuran. The surface chemistry involved is thermodynamically driven ring-opening reactions of cyclic azasilanes and cyclic thiasilanes with surface hydroxyls of carbon nanostructures to generate organofunctional amine (—NH2) and thiol/sulfhydryl (—SH) groups, respectively. FIG. 1 (A) depicts the reaction of cyclic azasilane with surface hydroxyls to form amine-functionalized (aminated) nanocarbon. Formation of such organofunctional groups enables further reactivity with organic moieties (e.g. organoboron, heterocyclic compounds, etc.) to form self-assembled carbon nanostructures.

The present application is also extended for generating dual functionalized (—SH and —NH2) nanocarbon species through simultaneous reactions with cyclic azasilane and thiasilane-based reagents.

A variety of cyclic azasilane and thiasilane coupling reagents are commercially available for use in the novel compositions that can support crosslink reactions with carbon nanostructures without the need of water as catalyst. They may be selected from the following: N-Allyl-Aza-2,2-Dimethoxysilacyclopentane, N-(2-Aminoethyl)-2,2,4-Trimethyl-1-Aza-2-Silacyclopentane, N-(3-Aminopropyldimethylsilyl)Aza-2,2-Dimethyl-2-Silacyclopentane, N-N-Butyl-Aza-2,2-Dimethoxysilacyclopentane, 2,2-Dimethoxy-1,6-Diaza-2-Silacyclooctane, (N,N-Dimethylaminopropyl)-Aza-2-Methyl-2-Methoxysilacyclopentane, 1-Ethyl-2,2-Dimethoxy-4-Methyl-1-Aza-2-Silacyclopentane, (1-(3-Triethoxysilyl)Propyl)-2,2-Diethoxy-1-Aza-2-Silacyclopentane.

The novel organosilane modified nanocarbon are prepared by any of several methods known to those skilled in the art, such as, but not limited to, anhydrous liquid phase deposition and vapor phase deposition. A liquid-assisted mechanochemical process is presented here as a preferred synthesis method for the instant embodiment. It involves high-energy ball milling or attrition milling of moisture-free carbon nanostructures (e.g. graphene, graphene oxide, nanodiamond, etc.) in presence of aprotic solvents containing 5-10% of cyclic azasilanes and/or thiasilanes in a temperature-controlled (60-115° C.) vapor-tight environment. During ball and attrition milling, the high-energy collisions exerted by the milling media introduces repeated fracturing, thermal shock, phase transition, and intimate mixing that facilitates stress-induced chemical reactions for bottom-up molecular self-assembly and structural changes of materials for top-down particle size reduction, deagglomeration, and dispersion. A post-curing step is implemented for complete removal of residual solvent followed by a dry milling step if ultrafine nanoparticulate output is desired. This innovative technique may represent a very cost-effective way for organosilane modification of carbon-based nanomaterials in scalable volumes for a wide range of industrial applications including lubricants.

Step 2. Organic modification of carbon nanostructures: In this preparation step, the organosilane modified carbon nanostructures (from Step 1) are ball milled in presence of one or more organic compounds of molybdenum, boron, phosphorus, sulfur, and heterocyclic compounds as described above. The mechanochemical reactions generated by mechanical motion/energy of ball milling triggers the molecular self-assembly of organic ligand(s) with amine and/or thiol-functionalized carbon nanostructures. Mechanochemical reactions affects the kinetic stability of molecules without any change in local temperatures and pressures. This is a critical advantage for avoiding thermal oxidation during fabrication of self-assembled nanocarbon. The resultant organic-modified nanocarbon additives possess superior tribotechnical properties, dispersibility and colloidal stability in complex media. For certain applications, instead of organosilane modified carbon nanostructures, pristine nanocarbon may also be used in this additive preparation step.

The above described preparation processes (step 1 and 2) can be used individually or in conjunction for manufacturing different types of the novel self-assembled additive compositions with a diverse selection of organic and nanocarbon-based materials disclosed in the present invention. For example, FIG. 2 illustrates the inventive sequential modifications to generate different types of self-assembled graphene additives.

In the novel additive compositions, the carbon nanostructures can be completely replaced or hybridized with other inorganic nanomaterials. They may be selected from titanium, molybdenum, tungsten, silicon, calcium, aluminum, tantalum, copper, silver, nickel, lithium, zinc, cadmium, zirconium, and their available compounds as sulfides, oxides, and/or nitrides. Other materials of interest are PTFE, hexagonal boron nitride, silicon carbide, and hydroxyapatite. Of course, variations and modifications of the foregoing are within the scope of the present invention. Thus, it is to be understood that the invention disclosed and defined herein extends to all alternative combinations of two or more of the individual features mentioned or evident from the text and/or drawings. All these different combinations constitute various alternative aspects of the inventive additive compositions and methods of making the same.

In another embodiment of disclosure, the inventive compositions relate to high-performing lubricant additives for providing improved friction reduction, antioxidancy, wear & corrosion resistance, electrothermal properties, and hydrolytic stability over traditional lubricant additives. The invention also relates to forming lubricant compositions containing an effective amount ranging from 0.1-30.0% of the of the novel self-assembled nanocarbon additives in a base stock, and optionally, one or more additives selected from the group including antioxidants, dispersants, detergents, antiwear additives, extreme pressure additives, friction modifiers, viscosity index modifiers, seal swell additives, defoamers, pour point depressants and corrosion/rust inhibitors.

The base stocks are typical oils/lubricants used in industrial and automotive applications, such as engine oils, turbine oils, gear oils, hydraulic oils, diesel oils, chain oils and greases. Depending on the operating conditions and temperature range of lubricants, the base oil composition can be either paraffinic, naphthenic, aromatic or combinations. The base oils derived from mineral oils (crude oils) and synthetic base stocks may be selected from the ones listed in Table 1.

TABLE 1

Base stock/oil categories

| | API & ATIEL Base Oil Categories | | | | |
|---|---|---|---|---|---|
| | Category | Sulfur % | Saturates % | Viscosity Index | Others |
| Mineral | Group I | >0.03 and/or <90 | | 80-120 | |
| | Group II | <0.03 and >90 | | 80-120 | |
| | Group III | <0.03 and >90 | | >120 | |
| Synthetic | Group IV | Polyalphaolefins (PAOs) | | | Polyintemalolefins |
| | Group V | All other base oils not included in Group I, II, III, and IV | | | |

For automotive lubricants (engine and gear oils), monograde or multigrade oils may be selected from viscosity grades specified as per SAE J300 and J306. For greases, the base stock may comprise one or more of above listed base oils and a soap or non-soap thickener system. Soap-based thickener systems may be selected from Lithium, Lithium complex, Sodium, Sodium complex, Calcium, Calcium Complex and Aluminum Complex. Non-soap thickener options may include polyurea, organophilic clay, PTFE, Silica, Calcium Sulphonate, and Carbon black.

Depending on the end application of the lubricant, following additional additives may be added to enhance chemophysical property of the lubricant composition as listed in Table 2. These additional additives are well known to those of skill in the art and are readily available for use in the inventive lubricant compositions. Examples of such additives are thoroughly described in the United States patents US20060199745A1, U.S. Ser. No. 00/976,5276B2, and US20120122744A1, which are incorporated herein by reference for description of additives listed in Table 2.

TABLE 2

Additional additives in lubricant formulations and their functions

| Additive | Typical Function |
|---|---|
| Antioxidant compounds | increase the oxidative resistance of base oil/lubricant |
| Dispersants | prevent deposit, sludge, and varnish build-up on critical metal surfaces |
| Detergents | keep metal components free of deposits and neutralize acids that form in the base oil |
| Friction modifiers | reduce friction in thin film boundary and mixed lubrication conditions |
| Extreme pressure & antiwear additives | prevent adhesive wear and protect metal components at elevated temperatures or in high pressure conditions |
| Defoamers/antifoam additives | eliminate existing foam and prevent the formation of further foam in the lubricants |
| Viscosity index modifiers | help lubricant to maintain their viscosity in changing temperatures |
| Seal swell additives | maintain integrity of elastomeric seal materials |
| Pour point depressants | enable base oil functioning at lower temperatures while retaining viscosity benefits at higher temperatures |
| Corrosion/rust inhibitor | protect metal components against rust and corrosion |

In addition to formulating new lubricant compositions, it is also contemplated that the novel self-assembled nanocarbon additives are effective top-treats to existing commercial lubricant formulations, e.g. passenger car motor oil (PCMO), heavy-duty diesel oil formulations, industrial gear oils, etc. For example, novel additive derived from MoDTC/1H-Benzotriazole coating of aminated nanodiamond may be desired for to improve the antiwear, antioxidant, corrosion inhibiting, frictional properties or in situ polishing/cleaning effect of an existing commercial motor oil or heavy-duty diesel engine oil. Similar top-treat efficacies of the inventive additive compositions can be realized with polymers as composites. For example, aminated graphene derived from 1,6-Diaza-2-Silacyclooctane modification may be desired as nano filler/additive for enhancing mechanical, tribological and thermoelectrical properties of polymers, such as polyester, polypropylene, epoxy, etc.

Based on the results of the tribotechnical performance testing set forth below, the inventive examples have been demonstrated to represent a new class of additives capable of exceeding the frictional and wear performance of traditional additives in lubricant and polymeric formulations.

EXAMPLES

The following examples are given for the purpose of illustrating the invention and are not intended to limit the invention. All percentages and parts are based on weight unless otherwise indicated.

Example 1

Organo-Silane Modified Nanocarbon 100 grams of commercially available nanocarbon powder, 50 grams of 2,2-Dimethoxy-1,6-Diaza-2-Silacyclooctane (10% in cyclohexane as available from Gelest as SID3543.1 Cyclic Azasilane) and an additional amount of 25 grams equivalent of cyclohexane were added to a zirconia milling vial with material to grinding/milling media (yttria stabilized zirconia) ratio of 2:1. For moisture-free reaction, the nanocarbon powder was pre-dried at 110° C. for 1.0 hours before milling. The mixture was milled in an air-tight high-energy ball milling apparatus (planetary ball mill) for 30 minutes at 70-75° C. for cyclic azasilane to react and crosslink with nanocarbon particles under continuous impaction and mixing. The milled mixture was then dried in an explosion proof oven for complete vaporization of the residual solvent. The dried mix was again milled with 1:1 material to grinding media ratio for 1.5 hours into a fine particulate form of organosilane-modified nanocarbon additives. Table 3 lists the as-prepared example additive compositions and their characteristics.

TABLE 3

Examples of organosilane modified nanocarbon compositions

| | Nanocarbon | | Organo-silane reagent |
|---|---|---|---|
| Additives | Type | Characteristics | Cyclic Azasilane |
| CaNGO-001 | Graphene oxide | Lateral size- 1-5 μm<br>Thickness- 0.8-1.2 nm<br>Carbon-content ≈ 51.26%<br>Oxygen Content ≈ 40.78% | Dimethoxy-1,6-Diaza-2-Silacyclooctane |
| CaNG-002 | Graphene nanoplatelets | Lateral size- 0.5-1 μm<br>Thickness- 3-7 nm<br>Carbon-content >97%<br>Oxygen Content <1%<br>Average layers- 6-10 | Dimethoxy-1,6-Diaza-2-Silacyclooctane |
| CaND-001 | Explosion synthesized diamond powder | Purity >95%<br>Average particle size- 3-4 nm<br>Morphology- spherical | Dimethoxy-1,6-Diaza-2-Silacyclooctane |

FIG. 3 shows a high-resolution TEM image of the novel aminated (amine-functionalized) graphene oxide derived from organosilane (cyclic azasilane) modification and XRD diffractogram of the same and as-procured commercial graphene oxide. In the XRD diffractogram, the strong peak at 2θ=11.6° (001 plane) confirms the oxygen functional group of graphene oxide with an interlayer d-spacing of about 0.76 nm. After the surface modification with cyclic azasilane, the peak was observed at 2θ=23.6° with an interlayer d-spacing of 0.38 nm confirming the formation of amine (NH2) functionalized graphene oxide.

Example 2

Organic-Modified Self-Assembled Nanocarbon Additives

Organic-modified nanocarbon additives as listed in Table 4 were manufactured by solid-liquid reaction of organofunctionalized-nanocarbon with organic compounds in a high energy ball milling apparatus. To avoid metal contamination, milling was performed in zirconia milling vials with yttria stabilized zirconia balls as milling/grinding media. The organic-inorganic constituents were milled for 3 hours in ambient temperature with material to milling media ratio of 2:1. The organic compounds used in the novel additives were acquired from commercially available precursors and products.

TABLE 4

Examples of organic-modified nanocarbon additive compositions

| Additive Composition | | Organic-Modified Nanocarbon Additives | | | | |
|---|---|---|---|---|---|---|
| | | AmG-01 | AmG-02 | AmD-03 | nD-04 | AmGO-05 |
| Nanocarbon species | CaNG-001 (organosilane-modified graphene) | 25 | 25 | 0 | 0 | 0 |

TABLE 4-continued

| Examples of organic-modified nanocarbon additive compositions | | | | | | | |
|---|---|---|---|---|---|---|---|
| | | | Organic-Modified Nanocarbon Additives | | | | |
| Additive Composition | | | AmG-01 | AmG-02 | AmD-03 | nD-04 | AmGO-05 |
| | | CaND-001 (organosilane-modified nanodiamond) | 0 | 0 | 1.0 | 0 | 0 |
| | | Pristine nanodiamond | 0 | 0 | 0 | 1.0 | 0 |
| | | CaNGO-001 (organosilane-modified graphene oxide) | 0 | 0 | 0 | 0 | 1.0 |
| Organic Compound Type | Organo-molybdenum | Molybdenum Dithiocarbamate (MoDTC) | 0 | 0 | 88 | 88 | 88 |
| | Heterocyclic Compound | 1H-Benzotriazole | 0 | 12.5 | 11 | 11 | 11 |
| | | 1-[N,N-bis (2-ethylhexyl aminomethyl] methylbenzotriazole | 25 | 12.5 | 0 | 0 | 0 |
| | Organo-boron | Trimethyl borate | 0 | 50 | 0 | 0 | 0 |
| | Organo-sulfur | Methylene-bis-dibutyldithiocarbamate | 30 | 0 | 0 | 0 | 0 |
| | Organo-phosphorus | Dilauryl hydrogen phosphite | 20 | 0 | 0 | 0 | 0 |

Example 3

Application of Novel Additives: Top Treatment of Formulated Diesel Engine Oil

Commercially available fully synthetic heavy-duty diesel engine oil was top-treated with 1.0 wt. % of AmD-03, nD-04, and AmGO-05 additive compositions:

Formula 1: Base Engine Oil+1.0 wt. % AmD-03

Formula 2: Base Engine Oil+1.0 wt. % nD-04

Formula 3: Base Engine Oil+1.0 wt. % AmGO-05

In this example, the "base diesel oil" is SAE 15W-40 viscosity grade fully formulated heavy duty diesel engine oil consisting of one or more base oils, dispersants, detergents, viscosity index modifiers, antiwear additives, antioxidants, pour point depressants and any other additives such that when combined with the inventive additive compositions makes a fully formulated engine oil.

0.5 quarts of the above formulations were prepared by 30 minutes mixing followed by 3 stages of sonication using an ultrasonic processor (each stage with 5 minutes sonication followed by 5 minutes cooling in ambient conditions). Dispersion stability of Formula 1 and Formula 2 are shown in FIG. 4 after twelve weeks of incubation period in moisture-free room temperature (72° F.) condition. Agglomerate settling of pristine nanodiamond (nD-04) was observed as compared to stable formulation with aminated (organosilane-modified) nanodiamond-based additive (AmD-03) demonstrating its enhanced dispersibility and colloidal stability in the formulated engine oil.

The lubricity of as-is and top-treated diesel engine oils was evaluated using high-frequency reciprocating rig (HFRR) using test conditions specified in ASTM D6079-18: Standard Test Method for Evaluating Lubricity of Diesel Fuels by the HFRR. For performance comparison, a commercial MoDTC-type friction modifier additive recommended for use in diesel engine oils was also tested. Coefficient of friction and wear scar diameter was used as the measurands of the lubricating properties of the oils.

Diesel engine oils top treated with the novel additive compositions (AmGO-05 and AmD-03) showed reduction in coefficient of friction while keeping the average wear scar well below 460 μm, as shown in FIG. 5. In comparison to an equivalent add-on of commercial MoDTC additive, MoDTC-modified aminated nanodiamond (AmD-03) and graphene oxide (AmGO-05) additives improved friction and antiwear properties of the engine oil. This confirms better tribological properties of the novel additives as compared to traditional lubricant additives.

Example 4

Application of Novel Additives: Extreme Pressure Antiwear and Corrosion Inhibition The novel self-assembled graphene-based additive (AmG-002) was added to grease formulations at 1.0 wt. % as multifunctional extreme pressure antiwear and corrosion inhibitor additive during the manufacturing stage of the grease products. In Table 5, the base grease A & B consist of all requisite ingredients except for any extreme pressure anti-wear and corrosion inhibitor additives and when combined with the inventive additive composition makes a fully formulated grease product.

TABLE 5

| Properties of base grease for testing extreme pressure antiwear and corrosion inhibiting property of the novel additive | | |
|---|---|---|
| Properties | Base Grease A | Base Grease B |
| Thickener Type | Lithium-complex | Lithium stearate |
| NLGI Grade | 2 | 1-1.5 |
| Base oil type | Naphthenic | Naphthenic |
| Base oil viscosity | 220 cST @ 100 F. | 150 cST @ 100 F. |
| 4-ball EP (kg) | 315 | 250 |
| Bearing corrosion | Fail | Fail |

Extreme pressure (EP) properties of the grease were tested as per ASTM D2596-10 using four ball method and steel bearing corrosion was assessed as per ASTM D1743 standard. With the addition of the novel AmG-002 additive, the extreme pressure of Lithium-complex and Lithium-based grease increased to 620 kg with a wear scar diameter of <0.5 mm With >96% increase in EP, the novel additives demonstrated the ability of its unique composition to withstand high load/pressure conditions and at the same time, was able to enhance anticorrosion properties to pass bearing corrosion rating.

Example 5

Application of Novel Additives: Top Treatment of Formulated PCMO

Commercially available passenger car motor oils (PCMO) were top-treated with 1.0 wt. % of AmD-03 additive composition using the same preparation method as described in example 2

Formula 4: Commercial 5W-20 Synthetic Blend Motor Oil+1.0 wt. % AmD-03

Formula 5: Commercial 5W-20 Conventional Motor Oil+1.0 wt. % AmD-03

The antiwear property and oxidation stability of the motor oils with and without the novel AmD-03 additive was tested using high-frequency reciprocating rig and thin-film oxygen uptake test (ASTM D4742). The test results shown in FIG. 6, confirms the wear-resistance and antioxidancy of the novel additive by reducing the wear volume and increasing the oxidation life of the PCMOs.

Example 6

Application of Novel Additives: Reinforced Polymer Composites

The mechanical reinforcing effect of the novel nanocarbon additive was evaluated in an epoxy system derived from bisphenol A resin reacted with modified polyamide. The novel organosilane-modified graphene nanoplatelets (CaNG-002, as described in Example 1) was added to the epoxy system at 2.0 wt. % and was compared to the control epoxy system (no reinforcing additives) and one containing 2.0 wt. % of pristine graphene nanoplatelets (without organosilane modification). Performance evaluation was made by measuring the abrasive mass loss (ASTM D4060 Taber abrasion method) of 4.5 mils thick epoxy/composite layer applied and air-cured on steel substrates under similar conditions of time, temperature, and humidity. The mass loss data from Taber abrasion test are presented in FIG. 7.

The effect on thermal conductivity from the addition of novel self-assembled nanocarbon additives were studied in a commercial transformer oil. Transformer oils are electrically insulating for use in oil-immersed transformers, capacitors, etc Enhancement in thermal conductivity of such fluids can enhance the life of transformer from overloading. Thermal conductivity and dielectric breakdown voltage of a commercially available hydrotreated naphthenic-based transformer oil was measured at varying add-on percentage of novel CaND-001 additive (organosilane-modified nanodiamond). Thermal conductivity showed an increasing trend with additive loading, reaching peak % enhancement of ~21% at 0.15 wt. % additive loading. Beyond 0.15 wt. % additive loading, thermal conductivity started to decrease. The dielectric breakdown voltage didn't show any significant change as compared to its original value of 40 kV up to 0.2 wt. % additive loading, thereby demonstrating the enhanced heat transfer ability of the novel additive without degrading the dielectric/insulating property.

Example 8

Application of Novel Additives: Reinforcement of Polymer Composite Coating

To demonstrate the performance of novel additives in polymeric system, AmG-02 additive was used to reinforce a 2k solvent based polyester/urethane DTM coating. The coating compositions and their characteristics listed in Table 6 are of polyisocyanate reacted two-component polyurethane coatings known to those skilled in the art. All the ingredients listed in the following compositions were commercially acquired except for the novel AmG-002 additive.

TABLE 6

Two-component solvent-based polyurethane coatings with and without novel additive

| Ingredients | Control coating | AmG-02 reinforced coating |
|---|---|---|
| | Part A | |
| Desmophen 631 A-75 | 4.0 | 4.0 |
| Carbon black SR511 | 0.65 | 0.65 |
| Desmorapid PP | 0.5 | 0.5 |
| Zinc Phosphate, SNCZ-PZ20 | 1.2 | 0.8 |
| MEK | 0.038 | 0.038 |
| MIBK | 1.0 | 1.0 |
| Byk 310 | 0.01 | 0.01 |
| Tinuvin 328 | 0.1 | 0.1 |
| DBTDL | 0.002 | 0.002 |
| Xylene | 0.5 | 0.5 |
| AmG-002 Additive (4% add on) | 0 | 0.4 |
| | Part B | |
| Desmodur N3300 | 2.0 | 2.0 |
| TOTAL (LBS) | 10 | 10 |
| | Application Conditions | |
| Part A:Part B | 4:1 | 4:1 |
| Cure Schedule | 35 min at 180° F. | 35 min at 180° F. |
| Coating Thickness (dry film) | 1.8 ± 0.2 mils | 1.8 ± 0.2 mils |
| Substrate | 4340 steel (blasted & phosphate treated) | 4340 steel (blasted & phosphate treated) |
| | Film properties | |
| Film hardness (pencil hardness) | H-2H | 3H-4H |
| Tensile Strength (psi) | 1000 | ~1600 |
| Direct Impact (in-lbs.) | 100 | 170 |

The protective properties of AmG-002 additive was clearly demonstrated with an increase in mechanical properties, including hardness, tensile strength and direct impact of the polymer composite coating. An increase in corrosion resistance was also observed from the 500 hours salt fog testing results as per ASTM B1117. As shown in FIG. 8, blisters were observed on the control coated industrial component (made of 4340 steel), while the organic-modified aminated graphene enhanced corrosion resistance of the coating despite decreasing the % content of inorganic corrosion inhibitor (zinc phosphate) by 4%. These results are a testament of the multifunctional properties of the novel nanocarbon additives to enhance chemophysical characteristics of polymer composite systems.

The invention claimed is:

1. An engine oil with additive compositions comprising one or more molecules selected from following group as shown by formula:

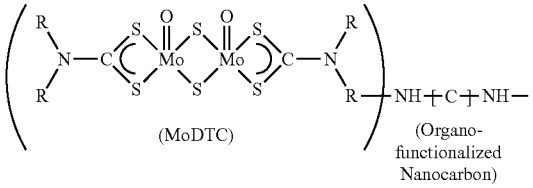

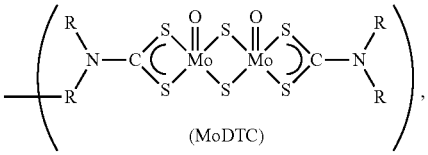

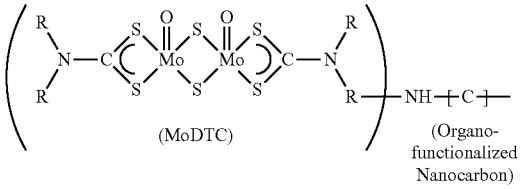

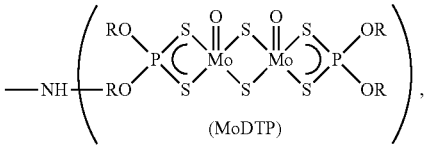

-continued

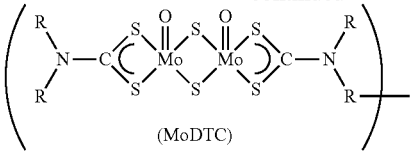

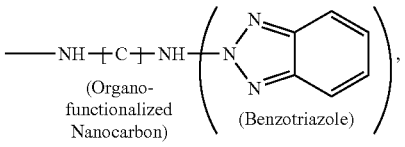

and

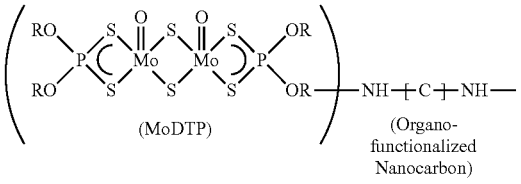

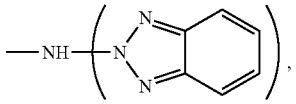

wherein, R denotes alkyl groups.

2. The engine oil of claim 1 wherein said oil is a base oil or lubricant comprising 0.1-30% by weight of the additive composition.

3. The engine oil of claim 1 wherein the one or more molecules has a formula:

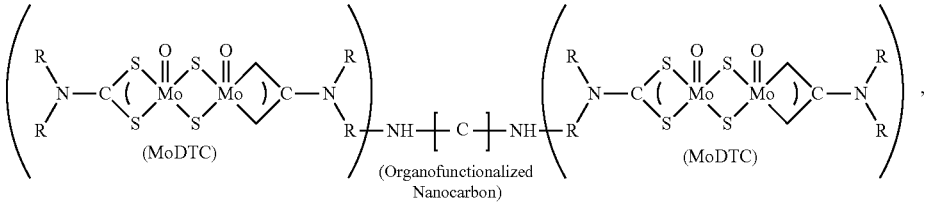

wherein R denotes alkyl groups.

4. The engine oil of claim 1 wherein the one or more molecules has a formula:

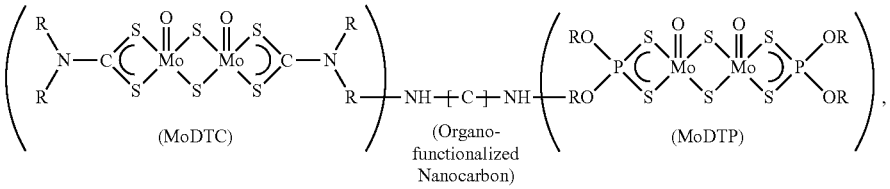

wherein R denotes alkyl groups.

5. The engine oil of claim 1 wherein the one or more molecules has a formula:

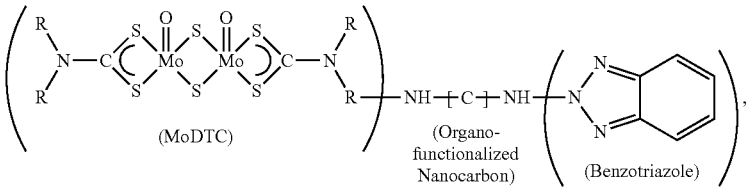

wherein R denotes alkyl groups.

6. The engine oil of claim 1 wherein the one or more molecules has a formula:

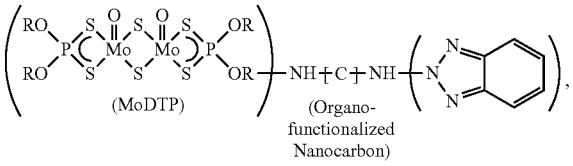

wherein R denotes alkyl groups.

7. The engine oil of claim 3 wherein said oil is a base oil or lubricant comprising 0.1-30% by weight of the additive composition.

8. The engine oil of claim 4 wherein said oil is a base oil or lubricant comprising 0.1-30% by weight of the additive composition.

9. The engine oil of claim 5 wherein said oil is a base oil or lubricant comprising 0.1-30% by weight of the additive composition.

10. The engine oil of claim 6 wherein said oil is a base oil or lubricant comprising 0.1-30% by weight of the additive composition.

* * * * *